United States Patent [19]

Suzuki et al.

[11] Patent Number: 5,073,796

[45] Date of Patent: Dec. 17, 1991

[54] COOLING SYSTEM FOR AN APPARATUS WITH A HEAT GENERATING ELEMENT THEREIN

[75] Inventors: Kensuke Suzuki; Hiromasa Kohayakawa, both of Tokyo, Japan

[73] Assignee: Kabushiki Kaisha Toshiba, Kawasaki, Japan

[21] Appl. No.: 238,782

[22] Filed: Aug. 31, 1988

[30] Foreign Application Priority Data

| | | | |
|---|---|---|---|
| Aug. 31, 1987 | [JP] | Japan | 62-215138 |
| Aug. 31, 1987 | [JP] | Japan | 62-215142 |
| Aug. 31, 1987 | [JP] | Japan | 62-215143 |
| Aug. 31, 1987 | [JP] | Japan | 62-215144 |
| Aug. 31, 1987 | [JP] | Japan | 62-215145 |
| Aug. 31, 1987 | [JP] | Japan | 62-215146 |
| Aug. 31, 1987 | [JP] | Japan | 62-215147 |

[51] Int. Cl.[5] ..... G03G 15/00; G03G 21/00

[52] U.S. Cl. ..... 355/215; 355/30; 355/210

[58] Field of Search ..... 355/30, 200, 210, 215

[56] References Cited

U.S. PATENT DOCUMENTS

| | | | |
|---|---|---|---|
| 4,202,618 | 5/1980 | Waschk et al. | 355/215 X |
| 4,202,623 | 5/1980 | Watkin | 355/30 |
| 4,695,151 | 9/1987 | Watanabe | 355/30 X |
| 4,704,348 | 11/1987 | Koizumi et al. | 355/30 X |
| 4,720,727 | 1/1988 | Yoshida | 355/215 |

FOREIGN PATENT DOCUMENTS

| | | | |
|---|---|---|---|
| 53-142243 | 12/1978 | Japan | 355/215 |
| 56-60475 | 5/1981 | Japan | 355/215 |
| 57-17957 | 1/1982 | Japan | 355/215 |
| 57-30851 | 2/1982 | Japan | 355/215 |
| 60-150079 | 8/1985 | Japan . | |
| 60-150080 | 8/1985 | Japan . | |

*Primary Examiner*—Fred L. Braun

*Attorney, Agent, or Firm*—Foley & Lardner

[57] ABSTRACT

An image forming apparatus includes a heat source, e.g., a lamp or a printed circuit board, and a fixing unit. A flow of air is circulated by a fan in a housing of the image forming apparatus. A cooling face of a cooling mechanism contacts the flow of air so that the flow of air is cooled. During the circulation of air, air cools the heat source. The cooling mechanism emits heat out of the image forming apparatus in response to cooling, without admitting air from outside of the apparatus.

19 Claims, 14 Drawing Sheets

COOLING SYSTEM FOR AN APPARATUS WITH A HEAT GENERATING ELEMENT THEREIN

BACKGROUND OF THE INVENTION

The present invention relates to an electronic apparatus which needs to be cooled inside, for example an image forming apparatus.

A machine using electricity is controlled easily, but heats up by virtue of heat generated by the electronic components in the circuit. The electronic components heat up during use, which affects their normal action.

It is well known that a machine using electricity needs to be cooled in some manner. A fan rotates air so that outer air is drawn into a housing and inner air is drawn out. This exchange of air helps cool the elements in the housing.

With the exchange of air, dust may be drawn into the apparatus being cooled, such as a copying machine, so as to affect the action of the copying machine mechanism. On the other hand, toner dust in the copying machine may be drawn out of the copying machine into the room so as to pollute the room environment.

The foregoing illustrates limitations known to exist in present devices. Thus, it is apparent that it would be advantageous to provide an alternative directed to overcoming one or more of the limitations set forth above. Accordingly, a suitable alternative is provided including features more fully disclosed herein.

SUMMARY OF THE INVENTION

It is an object of the present invention to provide a machine using electricity, wherein elements inside the machine are cooled without an exchange of air between the inside and the outside of the machine.

It is another object of the present invention to provide a copying apparatus which is cooled without the exchange of air between the inside and the outside of the apparatus.

These and other objects of the present invention are achieved by an apparatus with an element which generates heat comprising a housing accommodating the element, means for circulating air in the housing so that the element is in a flow of said air, means disposed in the flow of air for absorbing heat from the air and cooling the air, and means for emitting the absorbed heat out of the housing. An image forming apparatus is provided which transfers an image to a sheet, comprising means for illuminating an original image, means for making a latent image responsible to a light from the original, means for bringing a toner into contact with the latent image, means for transferring the toner to the sheet, means for fixing the toner to the sheet by heat, a housing accommodating the illuminating means, making means, bringing means, transferring means and fixing means, means for circulating air in the housing means disposed in the flow of air for absorbing heat from the air, and means for emitting the absorbed heat out of the housing.

The foregoing and other aspects will become apparent from the following detailed description of the invention when considered in conjunction with the accompanying Figures. It is to be expressly understood, however, that the Figures are not intended as a definition of the invention, but are for illustration only.

DETAILED DESCRIPTION OF THE PREFERRED EMBODIMENTS

Figure 1:
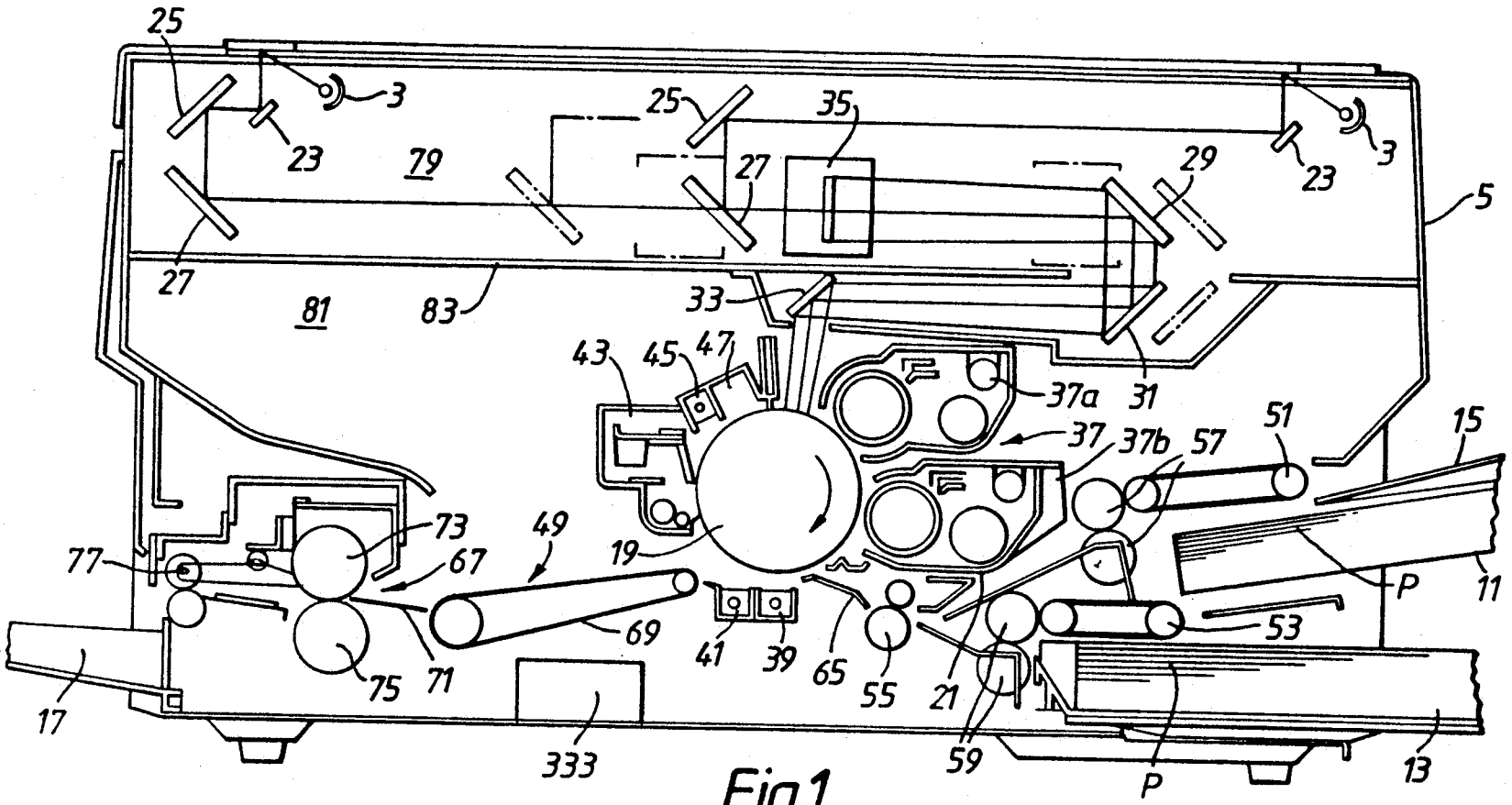
FIG. 1 is a schematic cross-sectional view of an image forming apparatus according to an embodiment of the present invention.

Referring to FIG. 1, the present invention is applied to an electrographic copying machine 1 in which a lamp 3 needs to be cooled.

Copying machine 1 includes a housing 5. An original table 7 made of transparent glass is arranged on an upper surface of housing 5. An operation panel (not shown in FIG. 1) is arranged on an upper front side of housing 5. An original cover 9 is pivotally supported on a rear side of housing 5. Upper and lower cassettes 11 and 13, for storing paper, are arranged on one side of housing 5. In addition, manual insertion guide 15, for manually feeding paper, is arranged above upper cassette 11. Receiving tray 17 is arranged on the other side of housing 5.

Photosensitive drum 19 is arranged at substantially the center of housing 5 to be rotated in a direction indicated by a directional arrow. Scanning unit 21 having lamp 3, a plurality of mirrors 23, 25, 27, 29, 31 and 33, and lens 35 is arranged between photosensitive drum 19 and original table 7. An original on original table 7 is illuminated by lamp 3. Reflected light from the original is guided and focused onto photosensitive drum 19 through mirrors 23, 25, 27, 29, 31 and 33, and lens 35. At this time, lamp 3 and mirror 23 are moved at a speed twice that of mirrors 25 and 27. As a result, the length of the optical path from the original to photosensitive drum 19 is kept constant.

Developing apparatus 37, transfer char 39, separating charger 41, cleaner 43 discharging lamp 45 and charger 47 are arranged in the order named around photosensitive drum 19 from an imaging position by scanning unit 21 along its rotational direction. The surface of photosensitive drum 19 is evenly charged by charger 47. Toner is applied onto photosensitive drum 19 by developing apparatus 37 to develop an electrostatic latent image. As a result, a toner image is formed on photosensitive drum 19. Developing apparatus 37 comprises first and second developing units 37*a* and 37*b*. Developing units 37*a* and 37*b* use toner having different colors. The toner image on photosensitive drum 19 is transferred onto paper P by transfer charger 39. Paper P is separated from photosensitive drum 19 by separating charger 41. Cleaner 43 removes the residual toner, which is not transferred from photosensitive drum 19 onto paper P but is left on photosensitive drum 19. Discharging lamp 45 illuminates all surfaces of drum 19 to be uniformally discharged.

A conveying mechanism 49 is arranged in a bottom portion of housing 5 so as to convey paper P form upper or lower cassette 11 or 13, or manual insertion guide 15, toward receiving tray 17. More specifically, paper P stored in upper or lower cassette 11 or 13 is picked out by pickup rollers 51 or 53, one by one. Paper P thus picked out is conveyed toward a pair of aligning rollers 55 through a pair of conveying rollers 57 or 59, and guides 61. Paper P, inserted in manual insertion guide 15, is fed to a conveying roller 64 by pickup roller 57 and is conveyed to aligning rollers 55. Paper P is aligned by aligning rollers 55. Then, paper P is conveyed to a transfer position through guide 65. Paper P is brought into contact with photosensitive drum 19 at the transfer position. In this state, a toner image on photosensitive drum 19 is transferred onto paper P. Paper P is separated from photo-sensitive drum 19 by separating charger 412. Then, paper P is conveyed to fixing unit 67 through conveying belt 69 and guide 71. Fixing unit 67 includes heat and press rollers 73 and 75. A release agent layer, such as fluorine resin is formed on the surface of heat roller 73. Press roller 75 is biased toward heat roller 73. Paper P is conveyed by heat and press roller 73 and 75 while being heated and pressed. As a result, the toner image on paper P is fixed thereon. Thereafter, paper P is sent to a pair of paper-discharge rollers 77, and guided outside housing 5 by discharge rollers 77. Paper P is discharged onto receiving tray 17 by paper-discharge rollers 88. These operations are controlled by a CPU and related circuits on a printed circuit board (not shown in FIG. 1).

Figure 2:
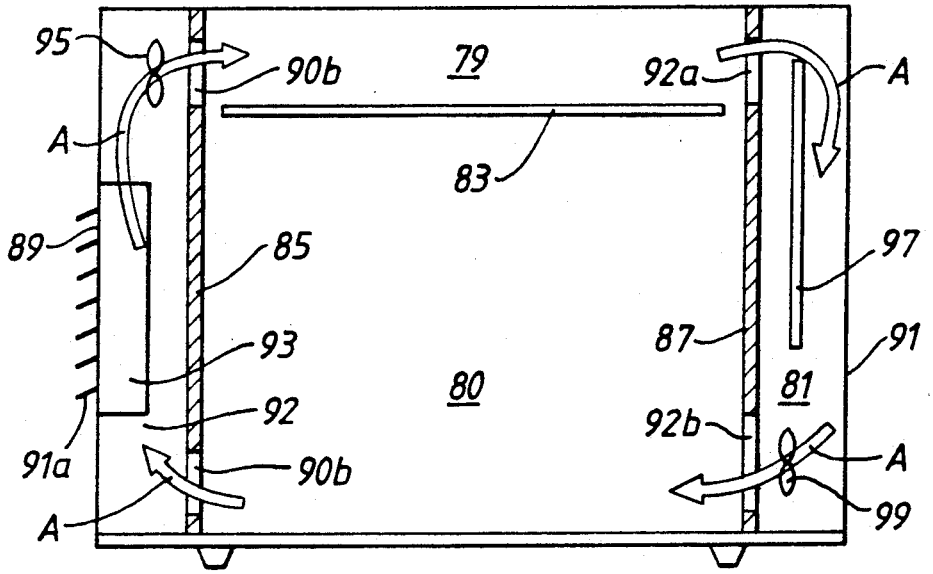
FIG. 2 is a schematic longitudinal sectional view of the image forming apparatus of FIG. 1.

As shown in FIG. 2, housing 5 is separated into upper, lower, front and rear rooms 79, 80, 81 and 82 by three separating boards 83, 85 and 87. Separating board 83 is substantially parallel to the original table, and fixed to right and left sides of housing 5. Separating boards 85 and 87 are substantially parallel to rear side 84 and front side 91 of housing 5. In this embodiment, the front side is the side that operator faces when using the copying machine. Separating boards 85 and 87 are fixed to the top and bottom of housing 5.

Upper room 79 is surrounded by separating boards 83, 85, 87 and the top frame of housing 5. Lower room 80 is surrounded by separating boards 83, 85, 87 and base frame of housing 5. Front room 81 is surrounded by separating board 87 and front side 91 of housing 5.

Rear room 82 is surrounded by separating board 85 and rear, right and left side 89 of housing 5. In separating board 85, there are upper and lower openings 90*a* and 90*b* which connect between upper room 79 and rear room 82, and between lower room 80 and rear room 82. In separating board 87 there are upper and lower openings 92*a* and 92*b* which connect between upper room 79 and front room 81, and between lower room 80 and front room 81.

In upper room 79 there are lamp 3, mirrors 23, 25, 27, 29, 31 and 33 and lens 35. In lower room 80 there are drum 19, developing apparatus 37, transfer charger 39, separating charger 41, cleaner 43, discharging lamp 45, charger 47 and conveying mechanism 49 and so on.

In rear room 82 there are cooling mechanism 93 and fan 95 to make a flow of air from rear room 82 to upper room 79 through opening 90*a*. In front room 81 there are printed circuit board 97, including elements to control each action of members for making an image, and fan 99 to make a flow of air from front room 81 to lower room 80. One of these elements is a CPU that is apt to heat up. Fan 99 makes air flow clockwise inside housing 5 shown as an arrow A. Housing 5 is not perfectly sealed up because cassettes 11 and 13 can be removed from housing 5. But the mechanism for removing cassettes 11 and 13 does not aid air in leaking outside housing 5. Very little air leaks from the mechanism while removing cassettes 11 and 13. Substantially, housing 5 of this embodiment is sealed up. It is desirable for housing 5 to be sealed up perfectly.

Fans 95, 99 are driven by a motor (not shown in FIGS. 1 and 2).

Figure 3:
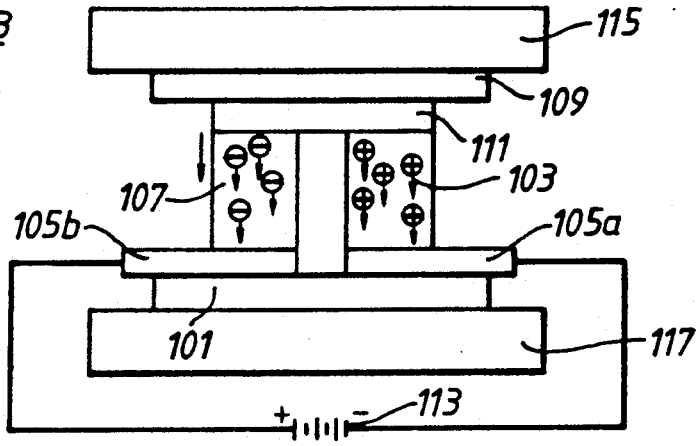
FIGS. 3 and 5 are schematic sectional views showing a cooling mechanism of a copying machine in the image forming apparatus of FIG. 1.

As shown in FIG. 3, the cooling mechanism can cool the flow of air which contacts cooling mechanism 93 by virtue of the Peltier effect, i.e. thermocouple.

Cooling mechanism 93 includes a heating face which is fixed to the rear side 89 made of a high heat conductivity material like steel for high heat radiation and a cooling face which is fixed so that the flow of air may collide with the cooling face. Referring to FIG. 2, there are a plurality of fins 91 as on rear side 89 where the heating face of cooling mechanism 93 is fixed.

Referring to FIG. 3, a basic model of the cooling mechanism described below. The cooling mechanism uses the Peltier effect, which is the reciprocal of the Seebeck effect.

In the Peltier effect, different kinds of metal or semiconductors are connected. When current is supplied via the connection, kinetic energy is decreased at one connection and increased at another connection. So one connection absorbs heat and another connection gives off heat.

Cooling mechanism 93 includes first high heat conductivity insulator 101 which is connected to a p-type semiconductor 103 through a first conductor 105*a* at one end of insulator 101 and an n-type semiconductor 107 through a second conductor 105*b* at the other end of insulator 101. P and n-type semiconductors are connected to a second high heat conductivity insulator 109 through conductor 111. The plus terminal of direct-current power supply 113 is connected to second conductor 105*b* and the minus terminal of power supply 113 is connected to conductor 105*a*.

In these connections, the carriers in the p-type semiconductor 103 is a positive hole that is drawn to first conductor 105*a*, and the carriers in n-type semiconductor 107 are electrons drawn to first semiconductor 107.

Therefore, second high heat conductivity insulator 109 can absorb heat and first high heat conductivity insulator 101 can give off heat.

In this embodiment, to make the efficiency of heat exchange high, aluminum plate 115 is attached to a second high heat conductivity insulator 109 and an aluminum plate 117 is attached to a first high heat conductivity insulator 101.

Figure 4:
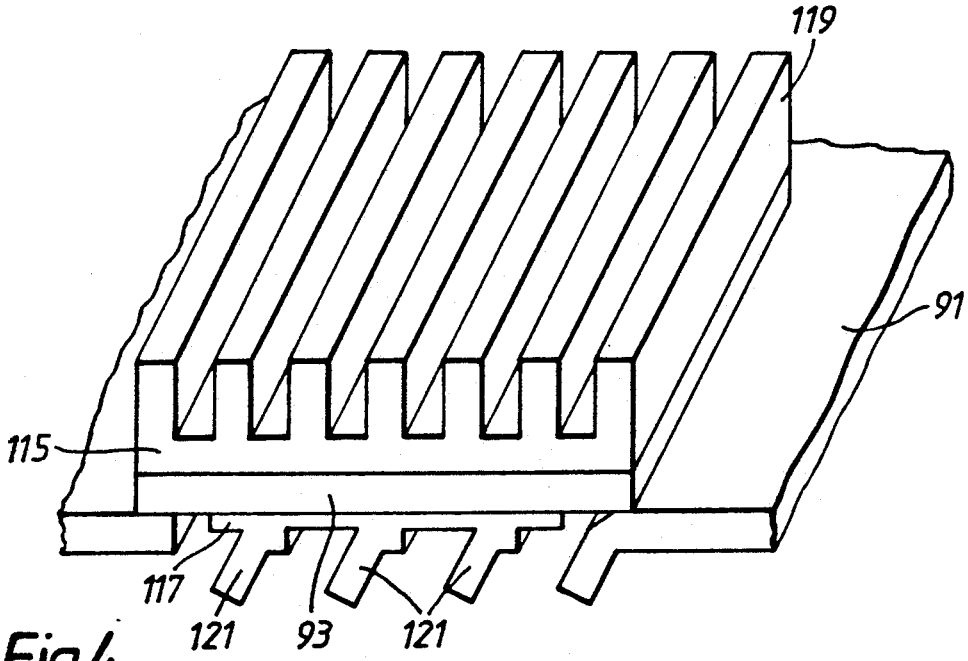
FIG. 4 is a perspective view of the cooling mechanism of FIG. 3.

Aluminum plates 115, 117 include fins 119 (FIG. 4) and 121 which can make more air contact with aluminum plate 115, 117 from the standpoint of heat exchange.

Figure 5:
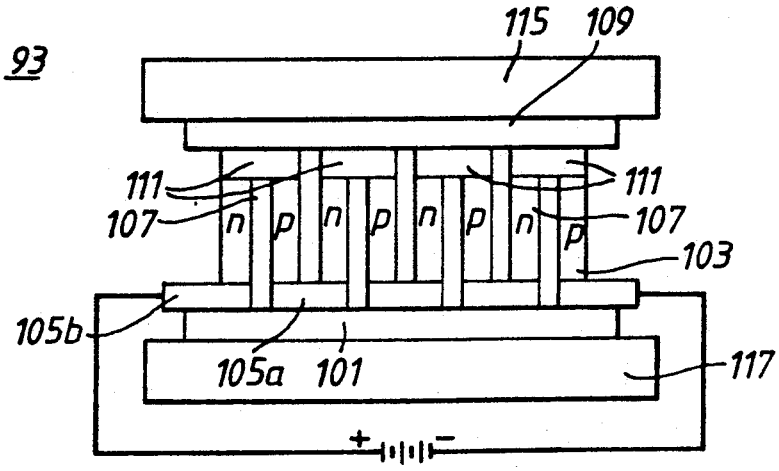

FIG. 5 illustrates another preferred embodiment in which a plurality of p- and n-type semiconductors are disposed in a row between first and second high heat conductivity insulators 101, 109 to absorb and give off much more heat.

There are a plurality of pairs of p- and n-type semiconductors 103 and 107 between a pair of insulators 101 and 109. With the exception of both ends of semiconductors 103 and 107, they are connected to same conductor 105*a* or 105*b*.

According to the construction above mentioned, the number of a place where heat exchange takes place is increased more than that in the construction shown in FIG. 3.

The copying machine as above mentioned comes into operation by turning on a copying button (not shown). Lamp 3 illuminates the original so that a latent image is formed on photosensitive drum 19. Lamp 3 generates a great amount of heat as it illuminates. The heat affects the characteristic of photosensitive drum 19.

A toner image formed on photosensitive drum 19 is transferred onto one surface of paper P fed from upper or lower cassette 11 or 13 or manual insertion guide 15, and then fixed thereon by fixing unit 67. Fixing unit 67 uses heat to fix a toner image. Paper P with a fixed image is sent from the copying machine.

During these operations, fans 95 and 99 continue to rotate to cause air to flow from lower room 80 to front room 81 through rear room 82 and upper room 79.

Air cooled by cooling mechanism 93 flows into upper room 79 to cool lamp 3. Air, after cooling lamp 3, flows into rear room 81 to cool printed circuit board 97. After this, air flows into rear room 82 though lower room 80. The cooling face of cooling mechanism 93 is exposed to air so that the air is cooled again by cooling mechanism 93. This process is repeated.

In housing 5, heat from lamp 3, printed circuit board 97 etc. is removed by air, and the heat of this heated air is removed by cooling mechanism 93. The heat taken by cooling mechanism 93 radiates from cooling mechanism 93 through the heating face of cooling mechanism 93. This heat is conducted by housing 5. The rear side of housing 5 radiates this heat so that cool air circulates in housing 5. Users of this machine who stand in front of front side 91 where the radiation of heat does not take place, do not feel unpleasant due to the blowing of heated air. According to this embodiment, there is no exchange of air between the inside and outside of the copier for cooling so that room dust does not enter the copying machine and toner dust does not go out of the copying machine.

Figure 6:
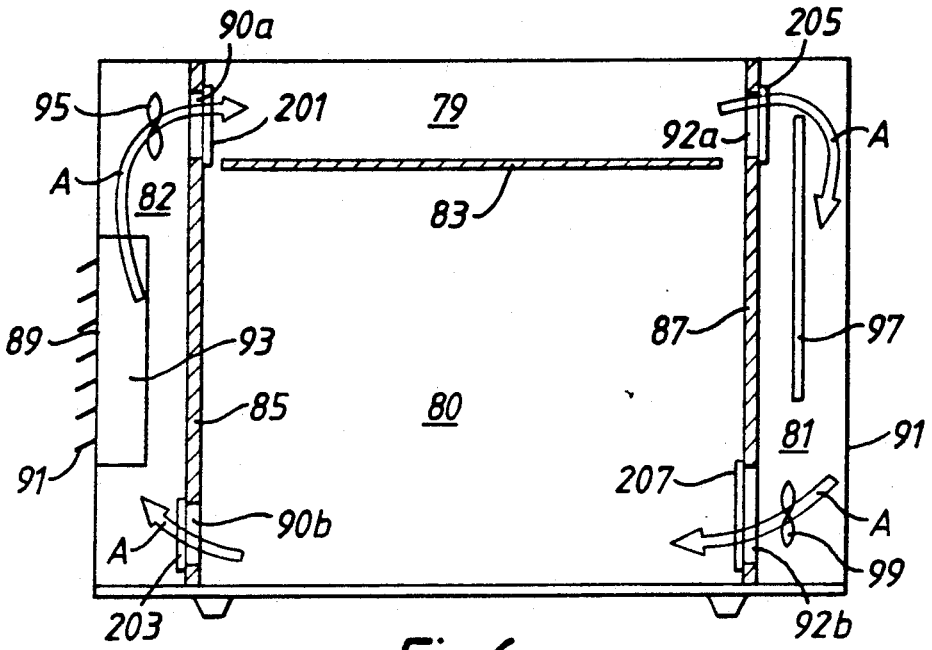
FIGS. 6 and 7 are longitudinal sectional views of an image forming apparatus according to the second and third embodiments of the present invention.

FIG. 6 illustrates another preferred embodiment in which filters 201, 203, 205 and 207 are attached to openings 90*a*, 90*b*, 92*a* and 92*b*. These filters 201, 203, 205 and 207 are made of fiber or resin for trapping dust such as flowing toner in housing 5. Alternatively, these filters 201, 203, 205 and 207 may be ozone-filters for trapping ozone. Filters 201, 203, 205 and 207 may be selected from one of a fiber filter, resin filter and ozone-filter.

According to this embodiment, contaminators like dust or ozone are trapped by filter 201, 203, 205 and 207 and will not be scattered in housing 5.

Figure 7:
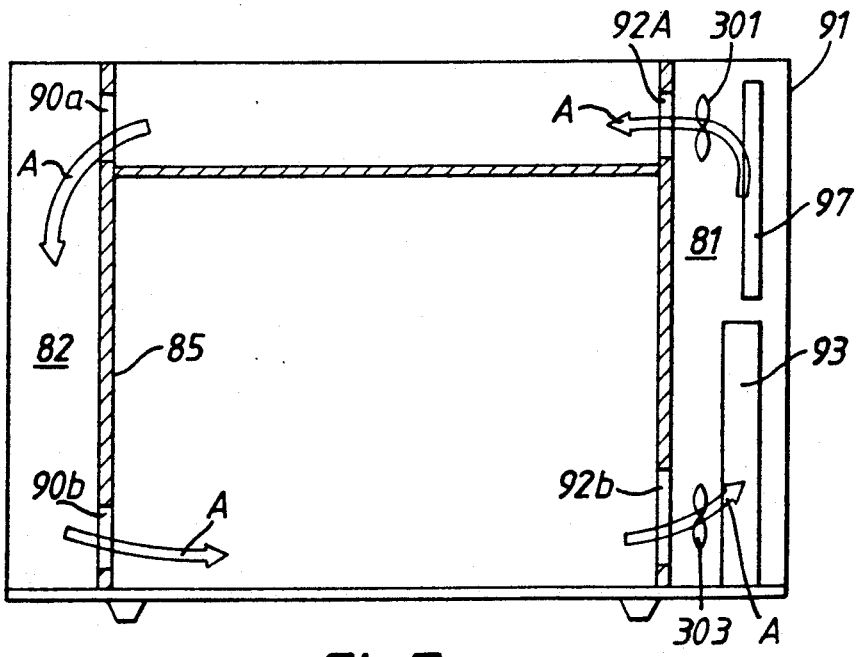

FIG. 7 illustrates another embodiment in which cooling mechanism 93 is disposed in front room 81. There are two fans 301, 303 facing openings 92*a*, 92*b* in front room 81. According to this embodiment, air cooled by the cooling mechanism flows first towards printed circuit board 97 so that elements on printed circuit board 97 are cooled efficiently.

Figure 8:
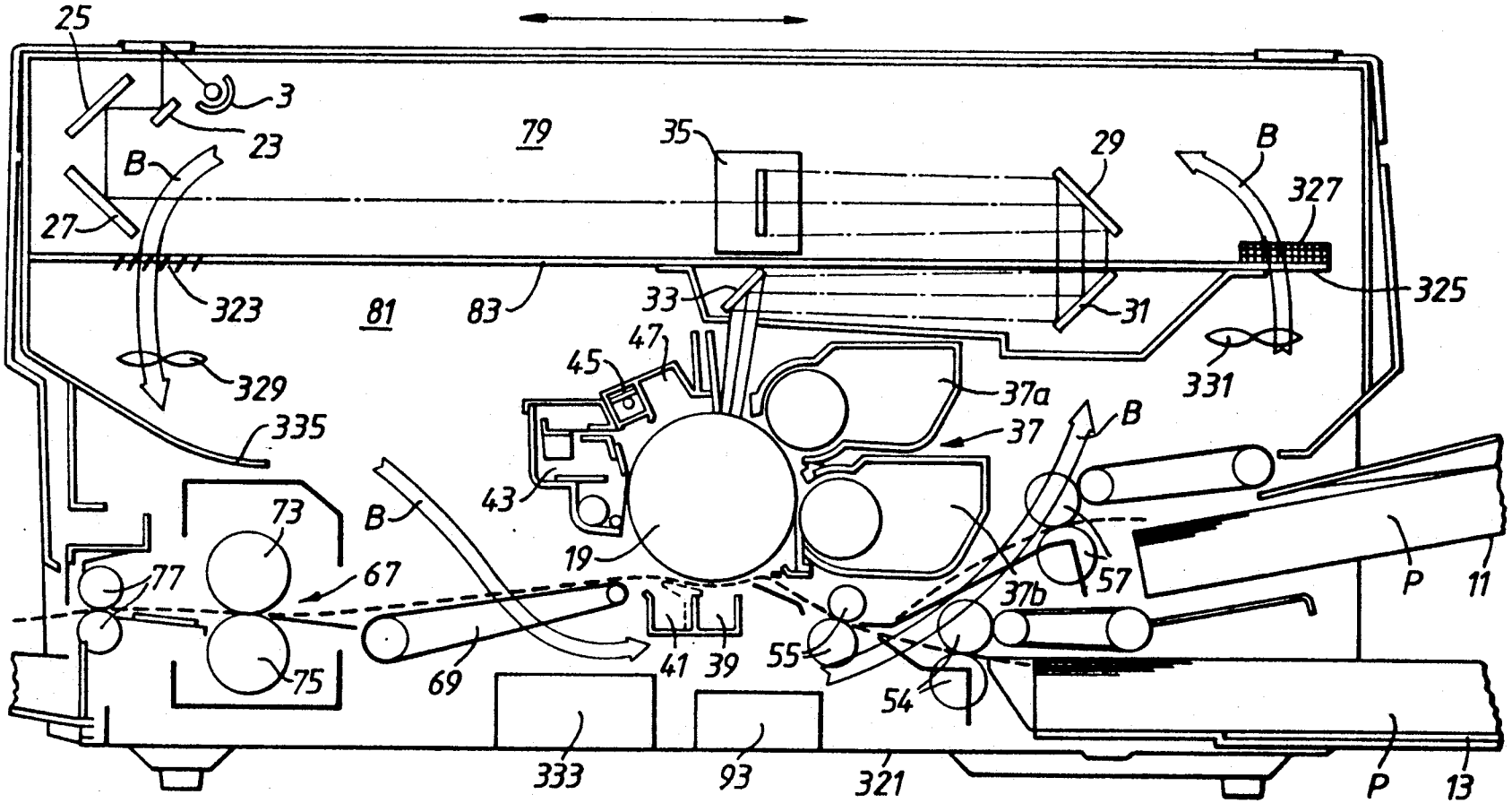
FIGS. 8 to 11 are cross-sectional views of an image forming apparatus according to the fourth to seventh embodiments of the present invention.

FIG. 8 illustrates another embodiment under drum 19 in which cooling mechanism 93 is disposed between photosensitive drum 19 and base frame 321 of housing 5. There is a cooling face of cooling mechanism 93 in the flow of air designated by arrow B. The heating face of cooling mechanism 93 is kept in contact with base frame 321 made of high heat conductivity material such as steel. There is a power transformer 333 adjacent to cooling mechanism 93 on base frame 321 that radiates heat generated from power transformer 333.

Referring to FIG. 8, this copying machine is divided between upper and lower rooms 79, 81 by separating board 83 which includes first and second openings 323, 325 at both ends of board 83. A second opening is covered by filter 327 in upper room 79. This filter prevents dust from scattering. There are two fans 329, 331 against the first and second openings. The fans may rotate in directions opposite to each other so that air flows counterclockwise as illustrated by the arrow designated B.

According to this embodiment, air flows not from the rear portion to the front portion but from the left portion of housing 5. Cooled air flows from a position under photosensitive drum 19 to second opening 325 by fan 331. Air flows into upper room 79 to cool lamp 3. This air flows into the lower room through first opening 323, but does not contact fixing unit 67. This is because of deflecting board 335 as shown in FIG. 8. Deflecting board 335 is a board which is positioned over fixing unit 67 to prevent air flow from being in contact with fixing unit 67. That is, air from upper room 79 is guided by deflecting board 335 that is settled over fixing unit 67 so that air flows not to fixing unit 67 but to power transformer 333. So, fixing unit 67 is not cooled, lamp 3 and transformer 333, etc. are cooled by cooling mechanism 93. Fixing unit 67 includes heat roller 73 which needs heat and does not need to be cooled from the stand point of making the image. Power transformer 333 is provided on base frame 321 so that base frame 321 conducts heat from power transformer 333 and this heat radiates from base frame 321.

Figure 9:
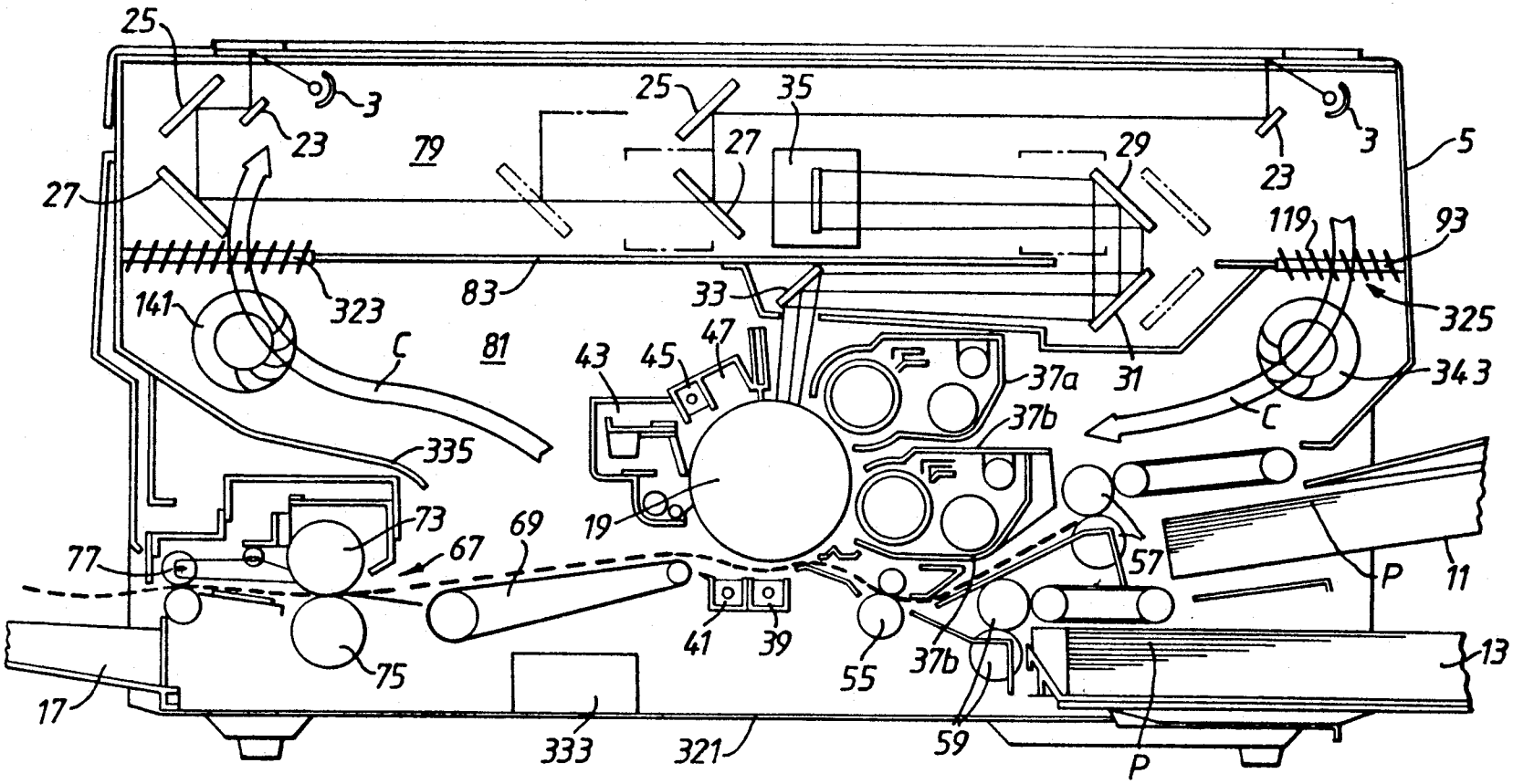

FIG. 9 illustrates another preferred embodiment in which air for cooling flows clockwise. This machine includes upper and lower rooms 79, 81 separated by board 83.

Board 83 includes first and second openings 323, 325. Cooling mechanism 93 is provided at second opening 325. This cooling mechanism 93 is basically the same structure as FIGS. 3 or 5. However, all of second opening 325 is not covered by cooling mechanism 93. .About half of second opening 325 is covered by fins 119 for cooling. Heating face of cooling mechanism 93 is attached to housing 5.

There are two fans 341, 343 under the first and second openings inside lower room 81. Motors 341, 343 may rotate in a direction opposite to each other. Air flows clockwise shown as by the arrow designated C.

According to this embodiment, elements in housing 5 are cooled down by cooling mechanism 93. Air from upper room 79 to lower room 81 may hold paper P onto the conveying mechanism, for example, a belt or guide, so that paper P may be prevented from being scattered. Moreover, air to lower room 81 prevents outer air from coming into housing 5 through an aperture provided for cassettes 11, 13. In this embodiment, air to lower room 81 behaves like a kind of air curtain.

While it is most important to cool lamp 3, it is also desirable to provide cooling mechanism 93 at first opening 323 and to cause air to flow clockwise. Therefore, most of the cooled air flows to lamp 3 first.

Figure 10:
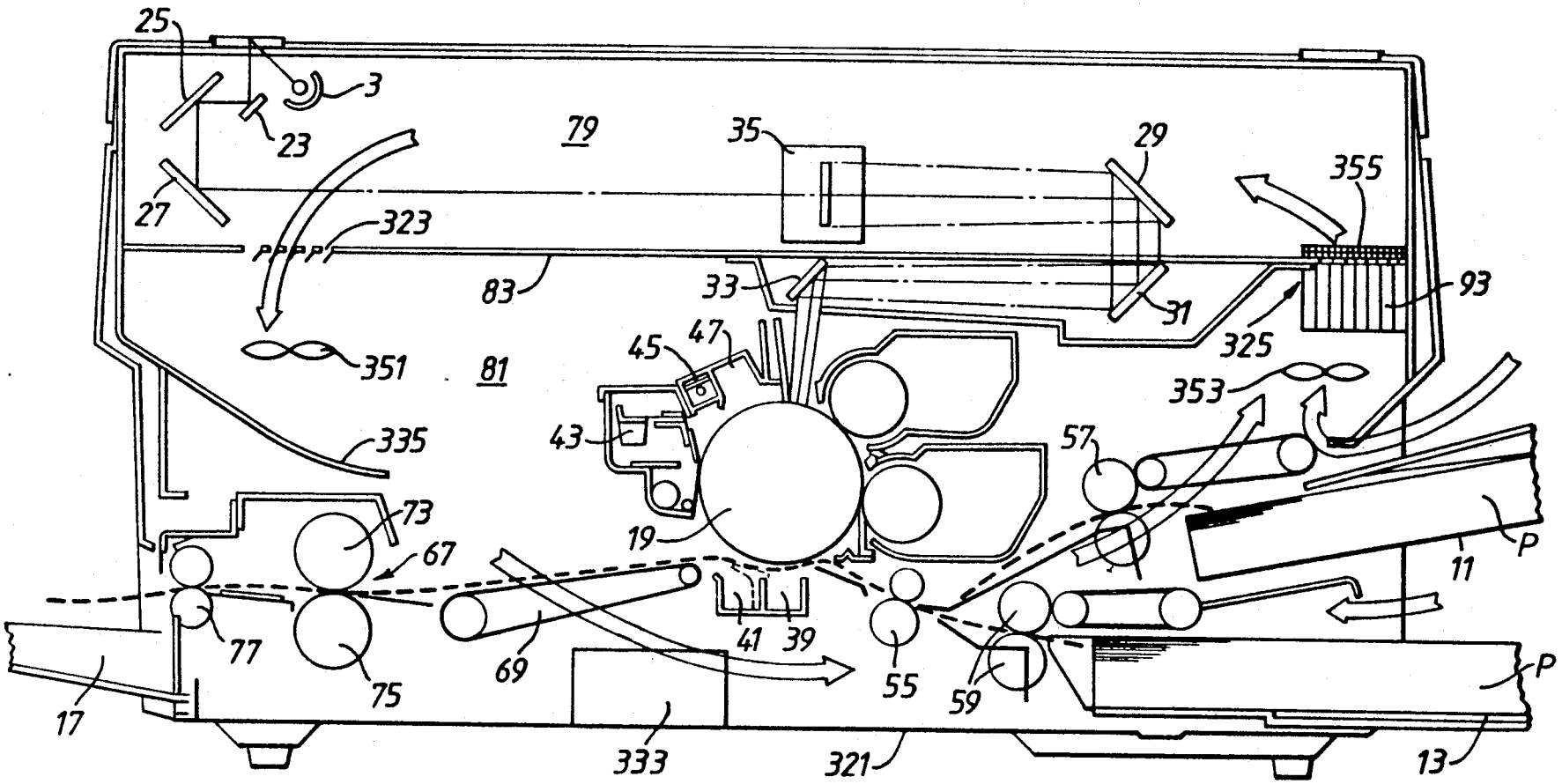

FIG. 10 illustrates another preferred embodiment in which two fans 351, 353 are provided under first and second openings 323, 325 inside lower room 81, especially fan 353 is provided between second opening 325 and cassette 11 so that fan 353 drives air to flow from lower room 81 to upper room 79 and from outside into inside housing 5.

According to this embodiment, a lot of air flows inside housing 5 so that air cooling is more efficient.

In this embodiment it is required that filter 355 is provided at second opening 325 in upper room 79. Filter 355 traps a lot of dust from the outside.

Cooling mechanism 93 is provided at second opening 325 in lower room 81. The cooling face of cooling mechanism 93 is exposed to air. The hating face of cooling mechanism 93 is fixed to housing 5.

Figure 11:
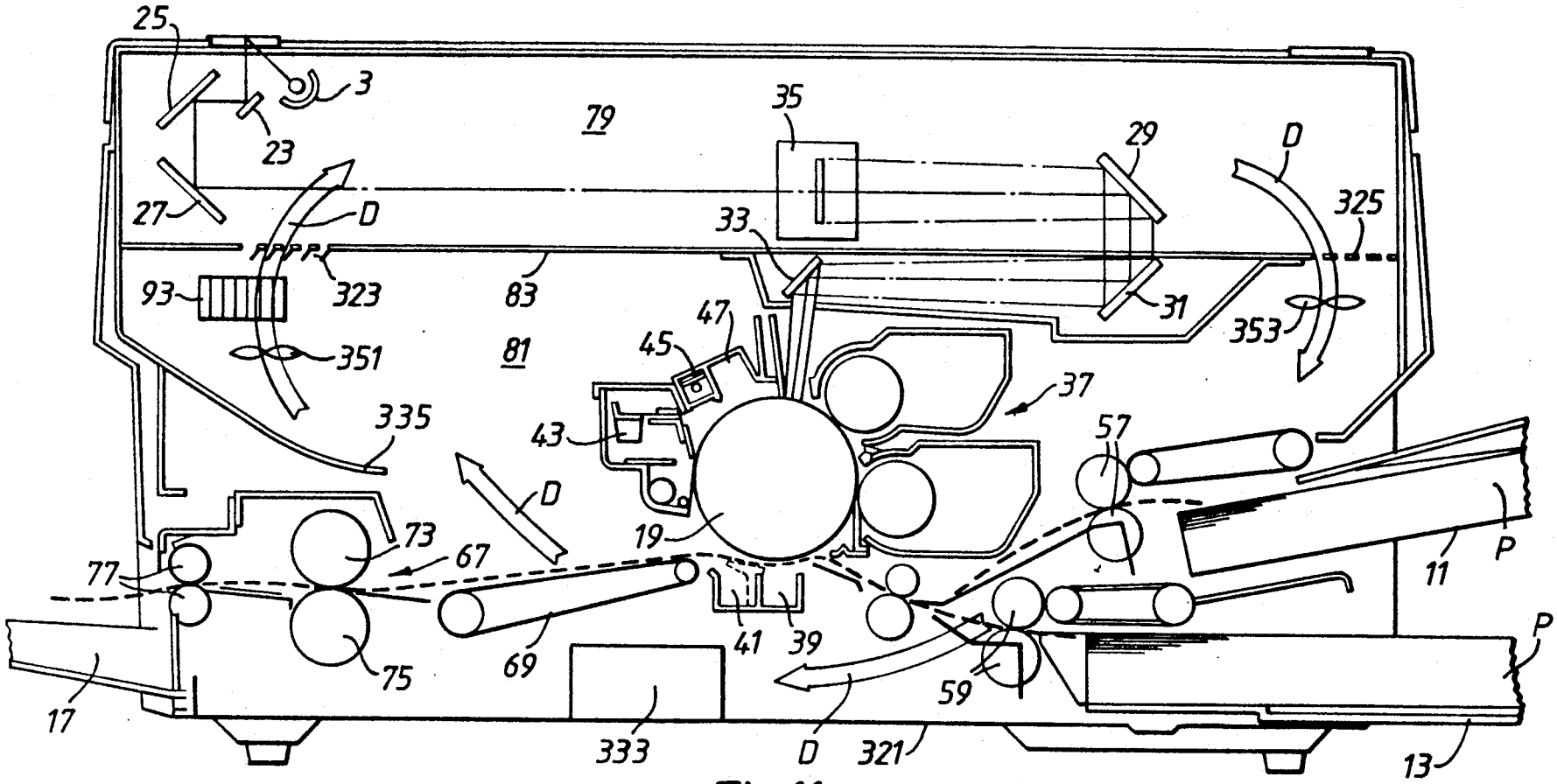

FIG. 11 illustrates another preferred embodiment in which cooling mechanism 93 is provided at first opening 323 in lower room 81. Two fans 351, 353 rotate in opposite directions to make air flow as indicated by the arrow designated D.

According to this embodiment, the cooled air flows to lamp 3 so that lamp 3 is cooled more efficiently.

Figure 12:
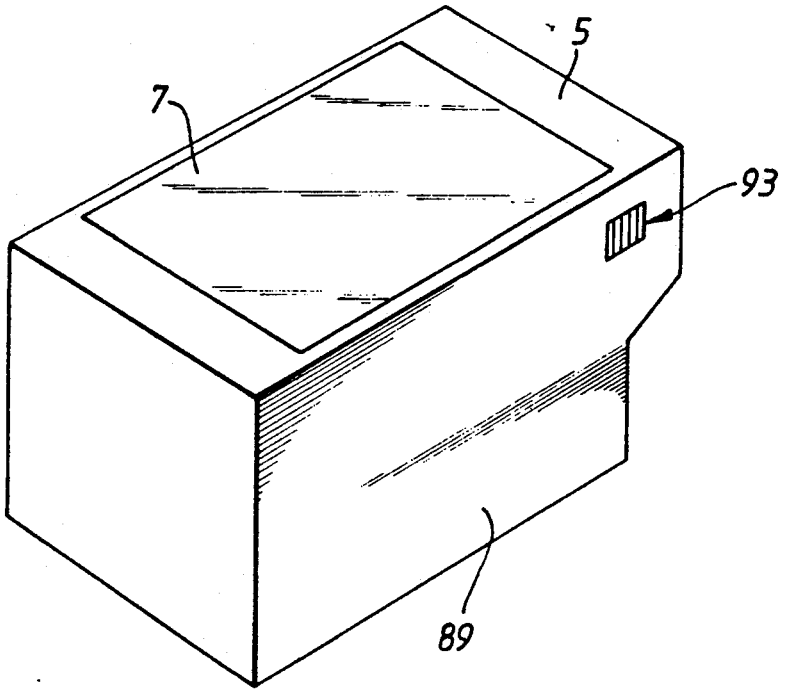
FIG. 12 is a perspective view of the image forming apparatus of FIG. 11.

FIG. 12 illustrates another preferred embodiment in which the heating face of cooling mechanism 93 crops out from rear panel 89 and the cooling mechanism may be provided at openings 323, 325 as shown from FIG. 9 to FIG. 11.

According to this embodiment, a lot of heat is radiated from housing 5 so that elements to be cooled in housing 5 are cooled more efficiently.

Figure 13:
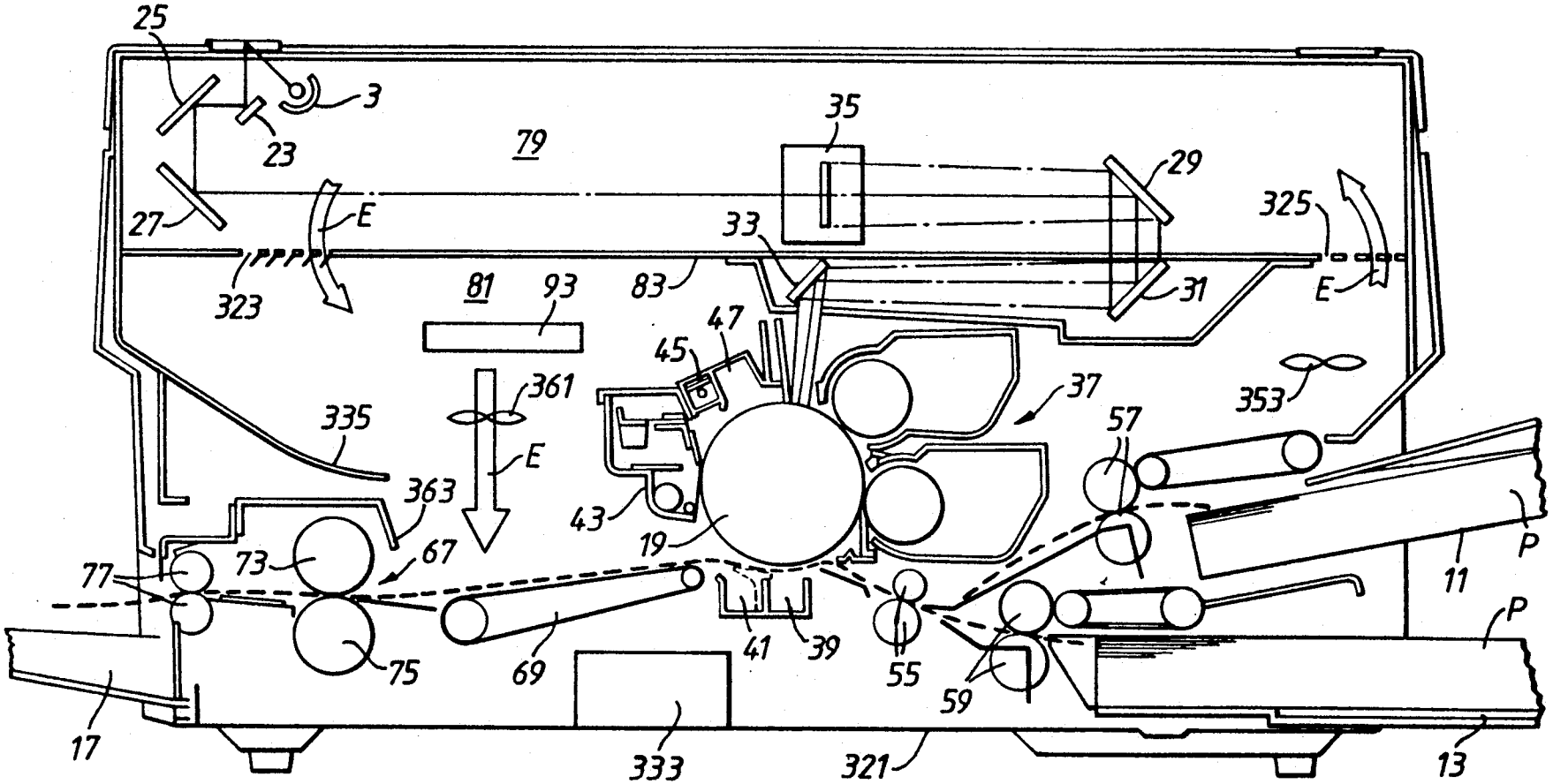
FIG. 13 is a cross-sectional view of an image forming apparatus according to an eighth embodiment of the present invention.

FIG. 13 illustrates another embodiment in which cooling mechanism 93 does not cool fixing unit more efficiently.

There is a first fan 361 between photosensitive drum 19 and fixing unit 67. Cooling mechanism 93 is placed over first fan 361 and near first opening 323 such that the cooling face of cooling mechanism 93 faces fan 361 and the heating face of cooling mechanism 93 faces board 83. First fan 361 makes cooled air run down in the space between photosensitive drum 19 and fixing unit 67 as shown in FIG. 13. Fixing unit 67 is covered by protection plate 363 against the flow of air such that protection plate 363 prevents cooled air from contacting fixing unit 67.

Cooled air from cooling mechanism 93 flows straight down to separate photosensitive drum 19 and fixing unit 67 from the standpoint of heat.

This air is drawn by fan 353 so that cooled air flows counterclockwise as shown by the arrow designated E.

Air flows from upper room 79 into lower room 81 and is guided by guide board 335. The guide board 335 mainly prevents air from upper room 79 from contacting fixing unit 67. Protection plate 363 mainly prevents cooled air from first fan 361 from contacting fixing unit 67.

According to this embodiment, elements to be cooled are cooled by air and elements not to be cooled (for example fixing unit 67) are not cooled by air because the flow of air behaves like a curtain to thermally separate fixing unit 67 from other elements.

Figure 14:
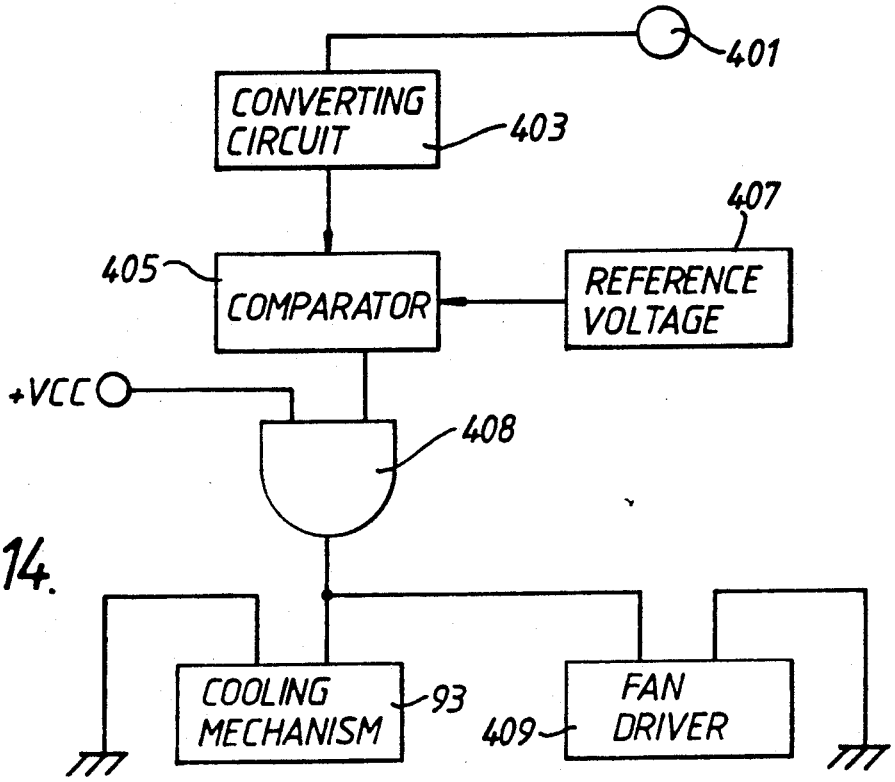
FIGS. 14 and 15 are perspective views showing an engaging block diagram for controlling cooling of the mechanism in FIGS. 3 to 5.
Figure 15:
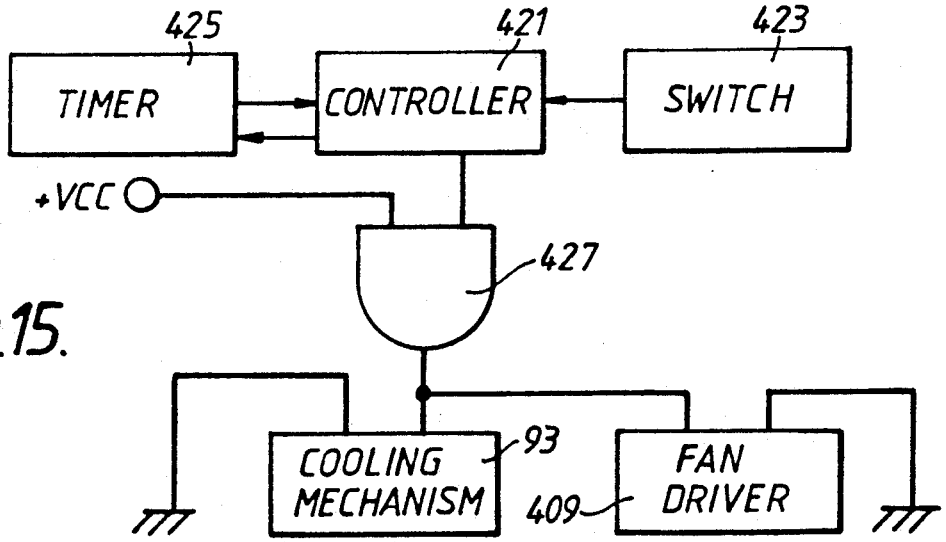
Figure 16:
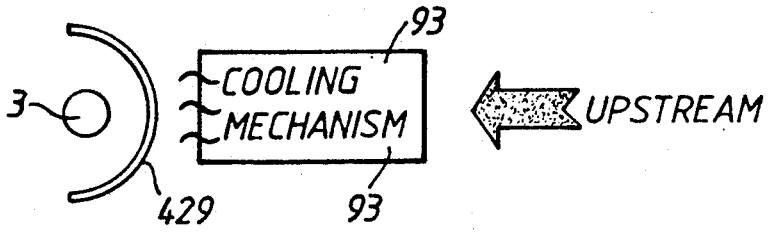
FIG. 16 is a schematic view for explaining a ninth embodiment of the present invention.

FIG. 14, FIG. 15 and FIG. 16 illustrate another embodiment in which cooling mechanism 93 is controlled.

Referring to FIG. 14, cooling mechanism 93 is started according to the temperature in the neighborhood of lamp 3.

Thermometer 401 is provided at the holding means of lamp 3. The output of thermometer 401 is supplied to converting circuit 403 that converts the output of thermometer 401 into corresponding voltage.

The output of converting circuit 403 is supplied to the first input terminal of comparator 405. Reference voltage generating circuit 407 generates a reference voltage corresponding to a maximum temperature at which the copying machine operates well. The output from reference voltage generating circuit 407 is supplied to a second input terminal of comparator 405.

Comparator 405 compares the two inputs and outputs a high level signal when voltage into the first input terminal is larger than that into the second input terminal.

The output of comparator 405 is supplied to one input terminal of "AND" circuit 405. Reference voltage +VCCO is supplied to another input terminal. The output of "AND" circuit 408 is supplied to cooling mechanism 93 and fan driver 409 which drives the fan.

Another terminal of each of cooling mechanism 93 and fan driver 409 are connected to ground. Cooling mechanism 93 and fan driver 409 start when "AND" circuit 408 supplies a high level signal to cooling mechanism 93 and fan driver 409.

After copying, elements in housing 5, for example lamp 3 and the printed circuit board, are heated and these elements make the surroundings hotter. The change of temperature is detected by thermometer 401 and converting circuit 403. When voltage corresponding to a detected temperature is larger than that of the reference voltage, cooling mechanism 93 starts to cool and fan driver 409 starts to rotate. Thus, air starts to flow inside housing 5 to cool the elements. After these elements are cooled down due a reduced air temperature being detected by thermometer 401, the "AND" circuit outputs a low level signal so that cooling mechanism 93 and fan driver 409 may stop.

It is desirable to drive fans 95, 99, 301, 303, 351, 353 or 361 other than due to temperature. Fan driver 409 continues to drive fans 95, 99, 301, 303, 351 or 361 during the time the copying machine is supplied with power to keep thermal distribution constant in housing 5 due to the flow of air.

FIG. 15 illustrates another preferred embodiment in which cooling mechanism 93 is controlled according to time.

Controller 421 is for the most part constituted by a CPU. Controller 421 is connected to power switch 423, timer 425 and "AND" circuit 427. The output terminal of "AND" circuit 427 is connected to cooling mechanism 93 and fan driver 409. Cooling mechanism 93 and fan driver 409 are connected to ground also.

By turning on power switch 423, all elements in the copying machine are supplied with power, and power switch 423 outputs a high level signal to controller 421.

Responsive to the high level signal, controller 421 outputs a high level signal to timer 425. Timer 425 reaches a predetermined number $T_1$ corresponding to a predetermined interval, timer 425 outputs a high level signal back to controller 421.

Responsive to the high level signal from timer 425, controller 421 outputs a high level signal to "AND" circuit 427. The "AND" circuit outputs a high level signal to cooling mechanism 93 and fan driver 409 so that cooling mechanism 93 and fan driver 409 start.

On the other hand, timer 425 continues to count. When the counting number goes to a predetermined number $T_2$ ($T_2 > T_1$), timer 425 stops counting, and clears the number. The output of timer 425 changes the high level signal to low a level signal, which is supplied to controller 421.

Responsive to this change, cooling mechanism 93 and fan driver 409 stop. At the same time, timer 425 re-starts to count. This process is repeated before turning off switch 423.

According to this embodiment, thermometer 401 is not used. Nevertheless, cooling mechanism 93 functions well.

FIG. 16 illustrates another preferred embodiment in which cooling mechanism 93 is disposed so that cooling mechanism 93 moves with lamp 3.

The cooling face of cooling mechanism 93 faces reflector 429 which is settled near lamp 3 and reflects light from lamp 3 to the original. Cooling mechanism 93, reflector 429 and lamp 3 are arranged in the order named starting from upstream.

According to this embodiment, lamp 3 is cooled. Restraint of the lamp's heat makes the lamp's lifetime longer and limits damage to photosensitive drum 19 due to the heat of lamp 3.

In this embodiment, it is desirable that starting and stopping of cooling mechanism 93 is controlled synchronously with the lighting of lamp 3.

Figure 17:
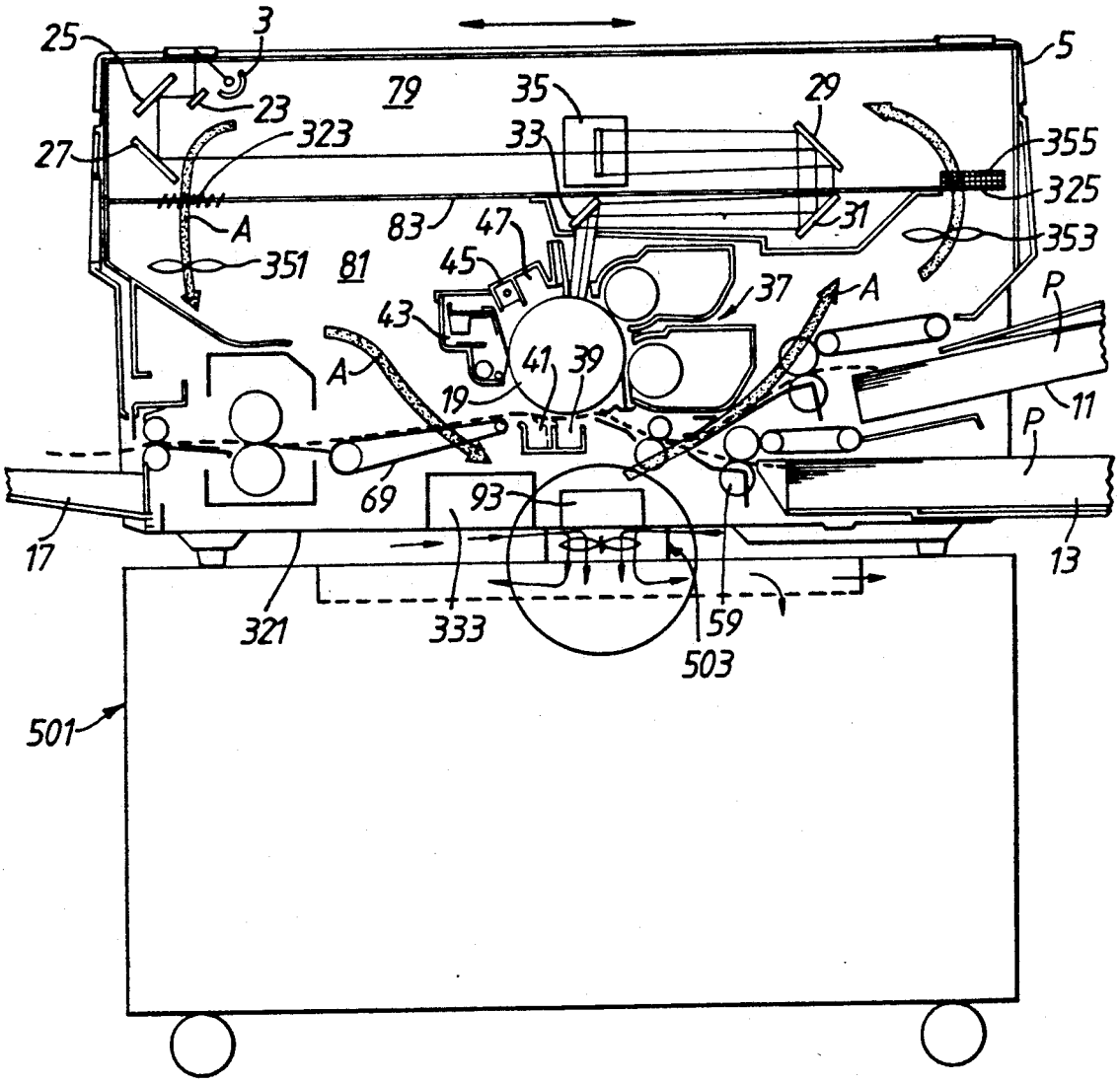
FIG. 17 is a cross-sectional view of an image forming apparatus according to a tenth embodiment of the present invention.

FIG. 17 illustrates another preferred embodiment in which heat from cooling mechanism 93 is used for removing dampness.

There is a cabinet 501 under housing 5. Cabinet 501 accommodates bundles of papers and cassettes. Housing 5 is constructed the same as that shown in FIG. 8.

Figure 18:
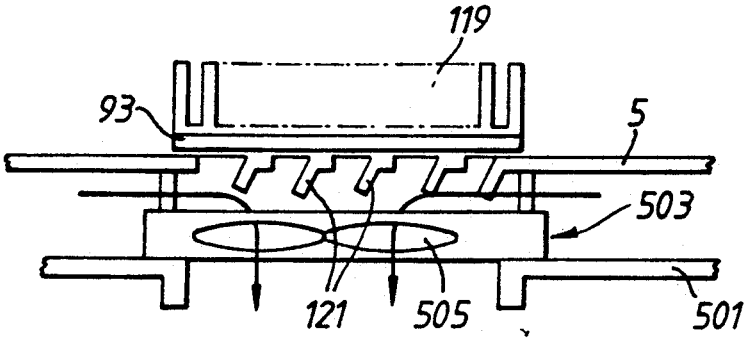
FIG. 18 is a sectional view showing a cooling mechanism and fan unit of FIG. 17.
Figure 19:
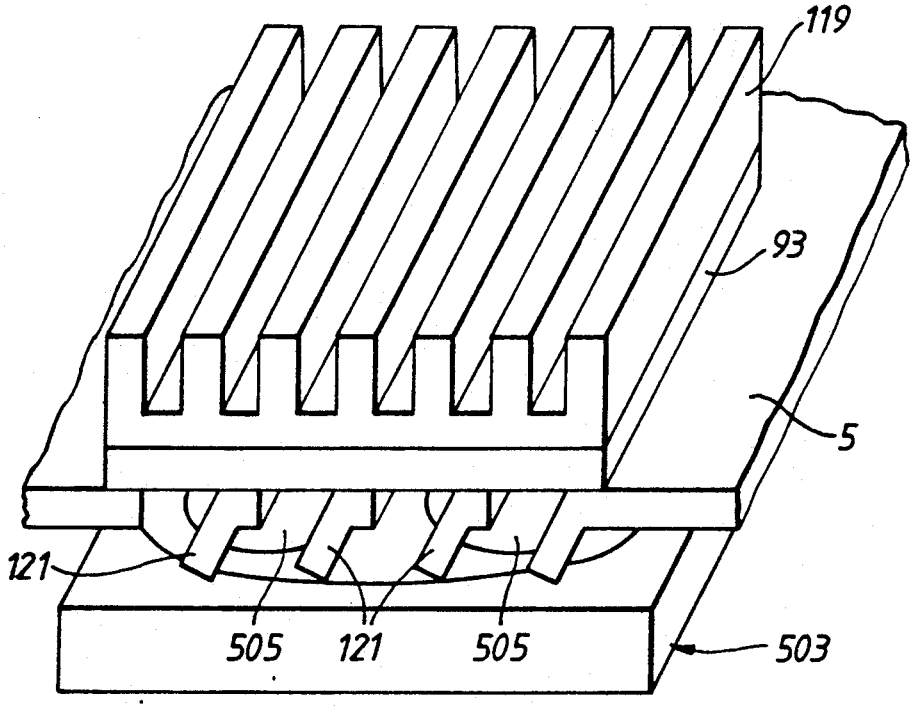
FIG. 19 is a perspective view of a cooling mechanism and fan unit of FIG. 18.

Referring to FIGS. 18 and 19, there is a fan unit 503 between housing 5 and cabinet 501. Fan unit 503 draws air from housing 5 into cabinet 501.

Fan unit 503 includes fan 505 which rotates to draw air from outside of housing 5.

Air from outside of housing 5 is in contact with fins 121 of cooling mechanism 93 so that heat in fins 121 is absorbed by air which is thus heated. Heated air flows into cabinet 501 through fan 505.

According to this embodiment, elements in housing 5, except fixing unit 67, are cooled and papers in cabinet 501 are dried.

Figure 20:
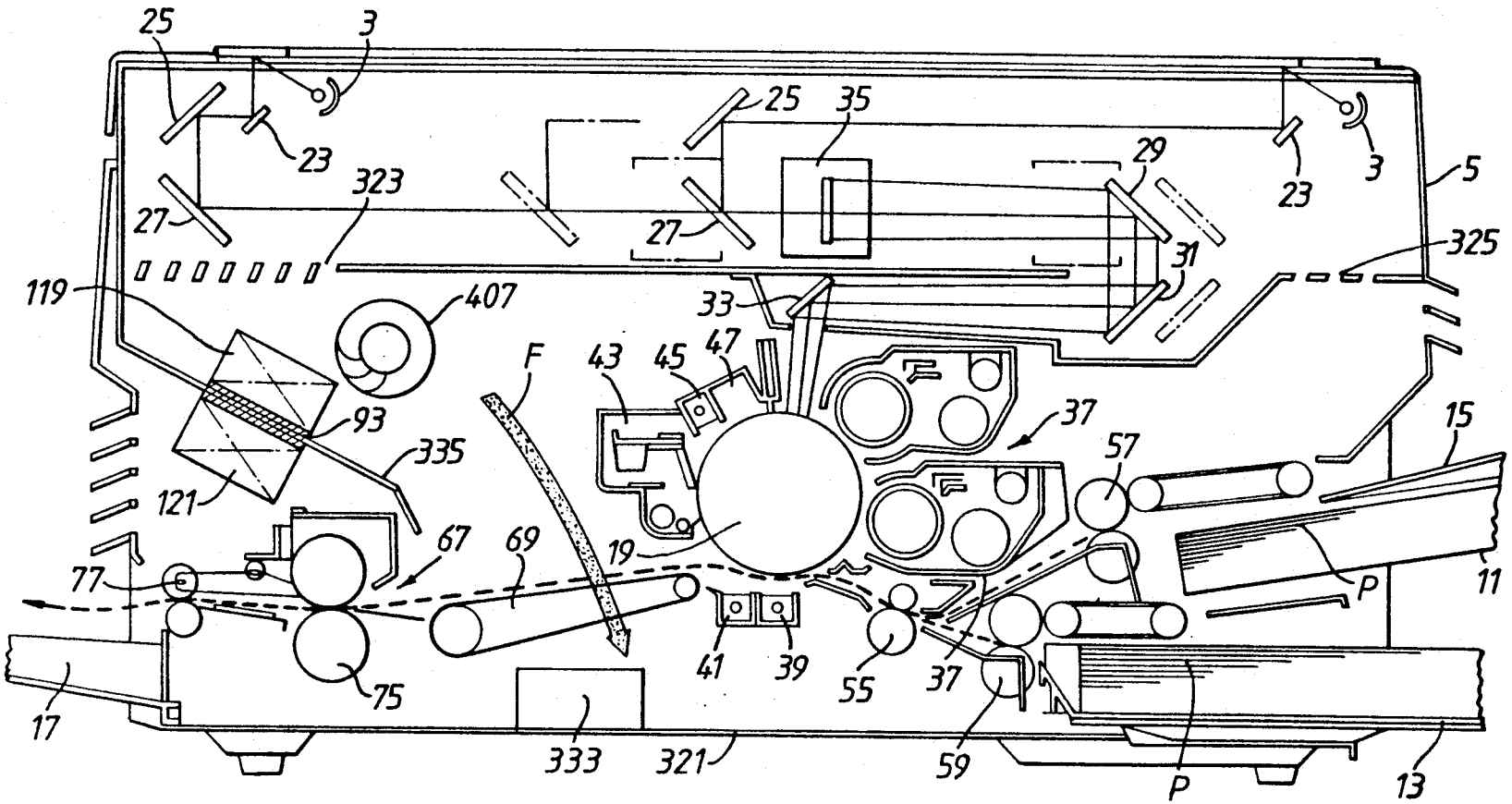
FIG. 20 is a cross-sectional view of an image forming apparatus according to an eleventh embodiment of the present invention.

FIG. 20 illustrates another preferred embodiment in which heat of cooling mechanism 93 is used.

Cooling mechanism 93 is provided through guide board 335.

There is a fins 119 for cooling the flow of air shown as indicated by the arrow F and a fins 121 for heating fixing unit 67. Air flows counterclockwise driven by fan 407. This air is cooled by fins 119 of cooling mechanism 93. Guide board 335 and protection plate 363 prevent cooled air from contacting fixing unit 67. Heated air from cooling mechanism 93 flows toward fixing unit 67. Fixing unit 67 is not cooled down, but is heated so that it is better able to fix toner image on paper. As described above, according to the present invention, cooling is done without an exchange of air between the inside and outside of the apparatus.

The position of cooling mechanism 93 may be selected depending on the needs of the cooling elements.

What is claimed is:

1. An apparatus containing an element which generates heat, comprising:

a housing accommodating said element;

means for circulating air in said housing so that said element is in the flow of said air;

means disposed in said flow of air, for absorbing heat from said air and cooling said air;

means for emitting said heat absorbed by said heat absorbing means out of said housing;

means for measuring a predetermined time; and means for actuating said absorbing means responsive to said time measuring means.

2. The apparatus according to claim 1, wherein said absorbing means and said emitting means include means for absorbing and emitting heat by generation of an electric current.

3. The apparatus according to claim 1, wherein said absorbing means and said emitting means include a thermocouple.

4. The apparatus according to claim 1, further comprising:

a board separating and defining a first room including said absorbing means and a second room including said element to be cooled with openings provided in such a manner that said air flows through said openings; and means disposed at least one of said openings for filtering dust.

5. The apparatus according to claim 1, further comprising:

means for sensing the temperature in said housing;

means for comparing said temperature and a predetermined temperature; and means for actuating said air circulating means responsive to said comparing means.

6. The apparatus according to claim 1, further comprising:

a cabinet accommodating a damp object; and means for transmitting said emitted heat into said cabinet.

7. An image forming apparatus which transfers an image to a sheet, comprising:

means for illuminating an original image;

means for making a latent image responsive to a light from said original image;

means for bringing a toner into contact with said latent image;

means for transferring said toner to said sheet;

means for fixing said toner to said sheet by heat;

a housing accommodating said illuminating means, making means, bringing means, transferring means and fixing means;

means for circulating a flow of air in said housing;

means, disposed in said flow of air, for absorbing heat from said air;

means for emitting said absorbed heat out of said housing;

means for measuring a predetermined time; and means for actuating said absorbing means responsive to said measuring means.

8. The image forming apparatus according to claim 7, wherein said absorbing means and emitting means include a thermocouple.

9. The image forming apparatus according to claim 7, further comprising:

means for defining and separating a first room including said absorbing means and a second room including said illuminating means with openings so that said air flows between said first and second rooms through said openings.

10. The image forming apparatus according to claim 9, wherein said absorbing means and emitting means include a thermocouple disposed at one of said openings.

11. The image forming apparatus according to claim 7 further comprising:

a circuit board including an element for performing an operation of the image forming apparatus;

means for defining and separating a first room including said absorbing means from a second room including said circuit board with openings so that air flows between said first and second rooms through said openings.

12. The image forming apparatus according to claim 11, further comprising:

means, disposed at least one of said openings, for filtering dust.

13. The image forming apparatus according to claim 7 wherein said emitting means is disposed on a base portion of said housing.

14. The image forming apparatus according to claim 7 wherein said emitting means is disposed on a rear side of said housing.

15. The image forming apparatus according to claim 7 further comprising:

a cassette for retaining a plurality of sheets;

means for transporting said sheets to said transferring means, and;

means for guiding said air to said cassette.

16. The image forming apparatus according to claim 7 further comprising:

means for preventing said flow of air from contacting said fixing means.

17. The image forming apparatus according to claim 7 further comprising:

means for guiding said air cooled by said absorbing means to said illuminating means.

18. The image forming apparatus according to claim 7 further comprising:

means for sensing the temperature in said housing;

means for comparing said temperature with a predetermined temperature; and means for actuating said absorbing means responsive to said comparing means.

19. The image forming apparatus according to claim 7 further comprising:

a cabinet, outside of said housing, accommodating paper and;

means for transmitting said emitted heat into said cabinet.

* * * * *